US007658139B2

(12) United States Patent
Helander

(10) Patent No.: US 7,658,139 B2
(45) Date of Patent: Feb. 9, 2010

(54) ELECTRICITY GENERATING DEVICE FOR USE IN AN ARMOUR ARRANGEMENT, AND AN ARMOUR ARRANGEMENT OF THIS KIND

(75) Inventor: Jyrki Helander, Eskilstuna (SE)

(73) Assignee: SAAB AB, Linköping (SE)

( * ) Notice: Subject to any disclaimer, the term of this patent is extended or adjusted under 35 U.S.C. 154(b) by 30 days.

(21) Appl. No.: 12/000,877

(22) Filed: Dec. 18, 2007

(65) Prior Publication Data

US 2009/0151549 A1 Jun. 18, 2009

(51) Int. Cl.
*F41H 5/0007* (2006.01)

(52) U.S. Cl. ..... 89/36.17

(58) Field of Classification Search ..... 89/36.17; 109/36, 37

See application file for complete search history.

(56) References Cited

U.S. PATENT DOCUMENTS

| | | | | |
|---|---|---|---|---|
| 5,070,764 | A | 12/1991 | Shevach et al. | |
| 5,293,806 | A | 3/1994 | Gonzalez | |
| 5,303,654 | A | 4/1994 | Held | |
| 5,419,565 | A * | 5/1995 | Gordon et al. | 473/455 |
| 5,577,432 | A * | 11/1996 | Becker et al. | 89/36.17 |
| 6,758,125 | B1 | 7/2004 | Zank | |
| 7,104,178 | B1 | 9/2006 | Zank | |
| 2007/0221052 | A1 | 9/2007 | Woodfin | |

FOREIGN PATENT DOCUMENTS

| | | | |
|---|---|---|---|
| GB | 2234334 | A | 1/1991 |
| GB | 2 295 003 | A | 5/1996 |
| WO | WO 2005/033615 | A1 | 4/2005 |
| WO | WO 2006/085939 | A2 | 8/2006 |

OTHER PUBLICATIONS

European Patent Office Search Report, dated Apr. 8, 2008, issued in connection with Counterpart Application No. EP 07 44 5041.2.

Norwegian Patent Office Action, dated Jun. 28, 2008, issued in connection with Counterpart Norwegian Application No. 20076538.

* cited by examiner

*Primary Examiner*—Stephen M Johnson
(74) *Attorney, Agent, or Firm*—Venable LLP; Eric J. Franklin

(57) ABSTRACT

An electricity generating device for use in an armor arrangement, and to an armor arrangement. The armor arrangement includes two inert reactive armor modules arranged one behind the other, which each include a plate made of inert material, interposed between steel plates. Sheet-shaped members are mounted or baked onto the inert material. The sheet-shaped members are provided with a number of mutually separate regions in which, or next to which, there are disposed elements which convert mechanical vibrations or shock waves in the inert material into electrical voltage. The elements can include crystals or piezoelectric layers. The ammunition part or ammunition effect which penetrates the inert reactive armor modules and which generates the mechanical vibrations or shock waves provokes in one or more elements the generation of a voltage which can be used to initiate counteragents against the penetration.

8 Claims, 2 Drawing Sheets

ELECTRICITY GENERATING DEVICE FOR USE IN AN ARMOUR ARRANGEMENT, AND AN ARMOUR ARRANGEMENT OF THIS KIND

TECHNICAL FIELD

The present invention relates to a device incorporated in an armor arrangement, which device reduces or eliminates the effect from armour-piercing ammunition. The arrangement here comprises, inter alia, IRA and ERA modules, where IRA=Inert Reactive Armour and ERA=Explosive Reactive Armour. The armour arrangement can also be integrated in a box and can comprise an outer armour, IRA and ERA modules and main armour.

PRIOR ART

Armour protection against armour-piercing ammunition is previously known in various embodiments. It is also known to put together different types of armour arrangement, which can here comprise outer armour which protects against small-bore ammunition and small-sized splinters. In addition, it is known to utilize the said IRA and ERA modules, main armour etc. An IRA module can here consist of steel plates with intervening inert material (for example plastics sheet). When an ammunition part strikes or acts against the IRA protection, shock waves are formed in the inert material, which makes the plating rise up next to the impact opening. The IRA module wholly or partially eliminates or arrests the ammunition effect. In the ERA module, the inert material is replaced with explosive substance. Various types of armour protection which are disposed in box-like arrangement and can be launched against approaching ammunition can also be found.

ACCOUNT OF THE INVENTION

Technical Problem

There is a need to further improve known armour protections and to refine these in order to reduce or eliminate the effect in question and, in dependence on the invasiveness of the effect, to initiate in a technically simple yet effective manner the counteragent, in the form of the ERA module, incorporated in the arrangement. The invention aims to solve this problem.

The arrangement must be able to be provided for fixed installations, combat vehicles, etc. and must be able to produce a sensitive and effective means of protection against shelling. The invention solves this problem also.

In connection with incorporation in boxes or other devices, problems can arise with the electrical energy supply for the aiming and triggering of current active armour. External electrical connections can in certain cases make the handling and use of the armour protection more difficult. In some cases, it is required that the generation of electricity which is produced with the IRA protection must be able to be realized wholly independently, or possibly in conjunction with an internal battery source in the box or equivalent. The invention solves these problems also.

In the event of shelling, strikes and penetration of the outer armour protection arrangement, there may be a need during the continuing combat to locate with great accuracy the point of penetration along the whole of the particular surface exposed to the shelling in order to be able effectively to combat by means of the ERA protection the continued penetration and infliction of damage. The invention solves this problem.

In connection with the various combat stages when the ammunition part or ammunition effect penetrates the armour arrangement, there is a need to be able to achieve an effective aiming and initiation of the utilized ERA protection. If a plurality of ERA modules are included, the correct modules must be triggered in each combat scenario. The invention solves this problem also.

In the present context, there is a need to be able to obtain effective component parts which can be integrated into an existing type of IRA protection. The invention solves this problem also.

The Solution

A device according to the invention may be deemed principally to be characterized in that it comprises at least two IRA modules arranged at a distance apart viewed in the direction of action of the ammunition part, in which the respective IRA module is provided with separate sub-zones arranged at a distance apart in the direction of extent of the module and situated within one and the same region of extent for the material in question, for example plastics material, of the IRA module, and is assigned or comprises elements, for example crystals, piezoelectric layers, etc., which, in dependence on mechanical vibrations or shock waves in the region of extent, initiate electrical voltage. The ammunition-related part or effect which penetrates to the IRA modules and generates the said mechanical vibrations or shock waves causes voltage to be generated in one or more elements, which can be used to initiate, wholly or in part, and/or provoke triggering of one or more ERA modules (counteragents).

In a preferred embodiment, sheet-shaped members are fixed or baked into a plate formed of inert material, which can here be constituted by a plastics plate, which forms part of the respective IRA module. The said shock waves or vibrations arise when the ammunition part or ammunition effect in question (for example RSV beam) strikes and possibly penetrates the plate. Member(s) running on current or voltage can be designed to react to the voltage generation or the voltage generations in one or more of the said elements. In dependence on the voltage generation in one or more elements under the action of the ammunition part or ammunition effect, the site of the point of penetration in the surface which is exposable to the ammunition effect is pinpointed with relatively great accuracy. The member(s) running on voltage and/or current can also be designed to detect the rate of penetration of the ammunition part or ammunition effect in question.

In a further embodiment, the said member(s) running on current and/or voltage is/are designed to store generated electrical energy, for example in a capacitor. The energy can subsequently be used to produce counter-measures during the shelling, i.e. selection and/or triggering of an ERA module or part of such a module.

An armour arrangement according to the invention can be characterized in that two successive IRA modules are designed, when penetrated by an ammunition part or ammunition effect and in dependence on mechanical vibrations or shock waves, to generate electrical voltage(s) by means of crystals or piezoelectric elements disposed on continuous surfaces on the inert material of the IRA modules. Member(s) running on voltage, current and/or energy is/are designed, in dependence on the said voltage generation by the elements on the continuous surfaces, to detect the point of penetration on that surface of the arrangement which is exposed to the weapon action and, in dependence on the detection, to produce or create voltage, current and/or energy for initiation and triggering functions for an incorporated ERA protection.

In one embodiment, the armour arrangement in question can here require, as a security condition for the initiation of the ERA module(s), that the penetrating ammunition part or ammunition effect must have a predetermined velocity value or velocity value range. As an additional or alternative triggering condition can be included the rapidity of the voltage build-up in the respective crystal or piezoelectric layers and/or the requirement that the voltage level must have a predetermined value or value range.

Advantages

The invention enables the ERA part to be orientated and configured within wide frameworks. Likewise, a new function, as well as structure and orientation, can be assigned to the IRA modules within broad frameworks. The IRA modules can detect various ammunition velocities. When the ammunition unit has struck a building, tree, natural object etc. and has therefore acquired low velocity at the point of impact, the ERA protection does not need to be triggered, which case can therefore be separated off by the new device. Likewise, the ERA protection must immediately be triggered in the event of velocities above a certain value, which can also be enabled with the new device. The generation of voltage or electricity can possibly be coordinated with an internal battery source and/or an external energy connection. Moreover, the site of impact can be effectively located on the possible total impact surface, which increases the effectiveness of the counteragent since this can be aligned and nominated and thereby optimized.

DESCRIPTION OF THE FIGURES

A currently proposed embodiment of an arrangement according to the invention shall be described below with simultaneous reference to the appended drawings, in which.

DETAILED EMBODIMENT

Figure 1:
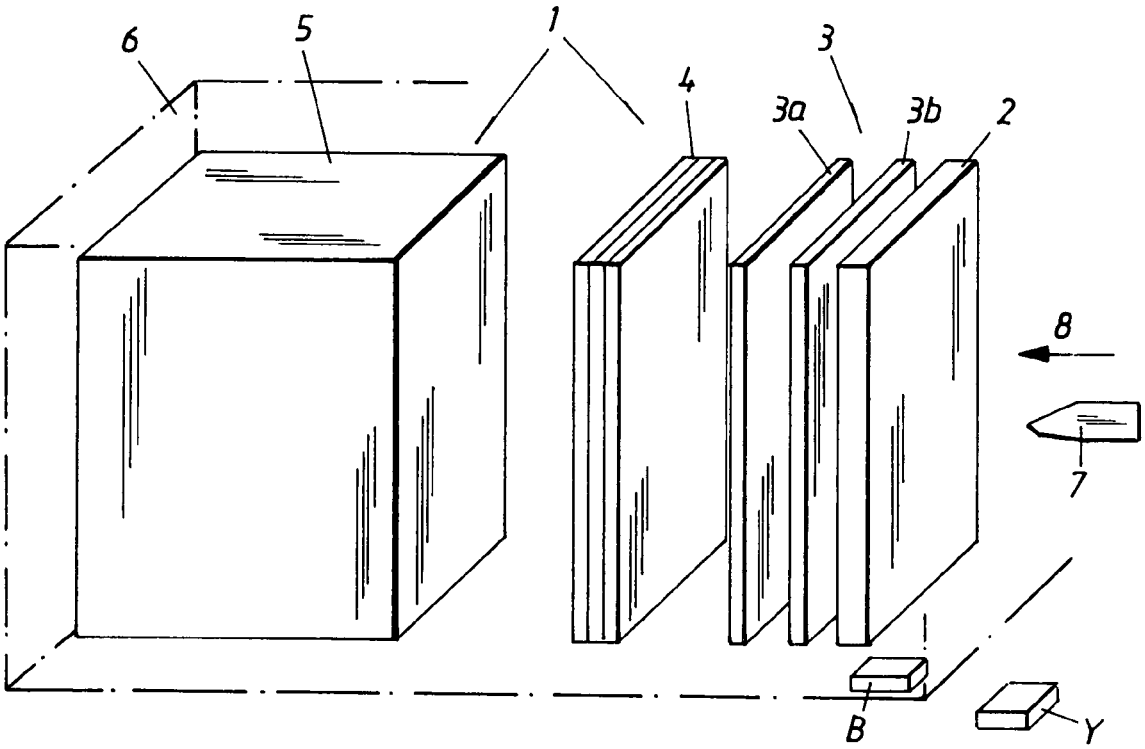
FIG. 1 shows the component parts in a basically defined arrangement for protection from armour-piercing ammunition, which arrangement can be coordinated in a box which can be launched or fired against approaching ammunition.

In FIG. 1, an armour arrangement is fundamentally represented by 1. The arrangement includes an outer armour 2, which protects against small-bore ammunition, small-sized splinters and the like. Should something penetrate the outer armour layer 2, for example a bolt or RSV beam, the velocity of the penetrating ammunition part or ammunition effect is measured in a unit 3, formed by two IRA modules 3*a*, 3*b*, which are known per se. The IRA modules 3*a*, 3*b* are followed by an ERA module 4, which in turn is followed by a main armour 5. The arrangement can be disposed on a fixed installation or on combat vehicles and can, per se, be enclosed in a box 6 or other enclosure arrangement. An approaching ammunition unit is denoted by 7 and the direction of approach by 8. Viewed in the direction of approach 8 of the ammunition part 7, the RSV beam, etc., the modules 3*a*, 3*b* are arranged one behind the other. The arrangement parts 2, 3, 4 and 5 can be constituted by a type which is known per se and which shall not therefore be further described here. The modules 3*a*, 3*b* can consist of steel sheets with a plate, for example a plastics material plate, of inert material in between. In the ERA module, the plate is replaced with explosive material.

Figure 2:
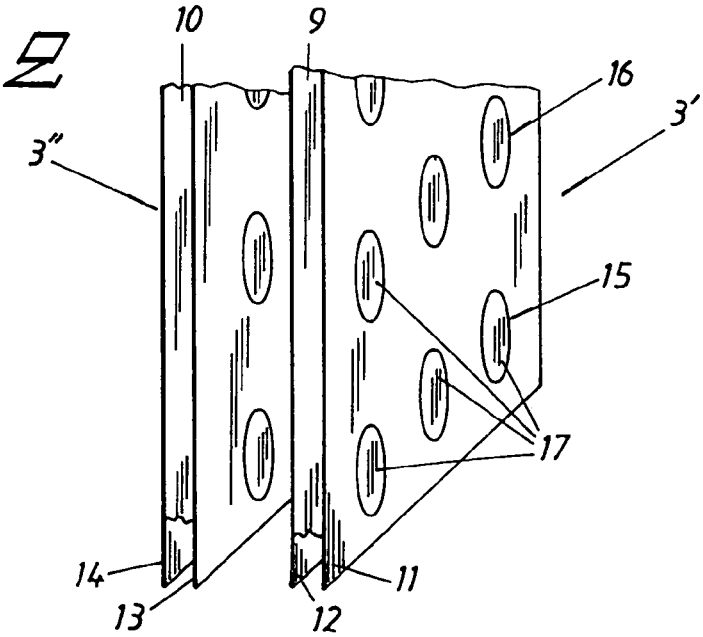
FIG. 2 shows, in perspective view from the right/from the front, parts of a unit with foil applied on both sides of sheet-shaped members, for example plastic plates.

FIG. 2 shows parts of the IRA modules 3', 3" in more detail. In one embodiment, the two IRA modules each comprise a plate 9 and 10, which, according to the above, can here be constituted by plastics plates of a material which is known per se. The IRA modules are mutually arranged such that the plastics plates remain arranged substantially parallel to each other. The respective plate bears sheet-shaped layers 11, 12 and 13, 14 on both its sides. The layers are provided with mutually separate zones (sub-zones), two of which are denoted by 15 and 16. In or on the said zones there are disposed elements 17 of the type which generate electrical voltage in dependence on mechanical vibrations or shock waves which arise in the respective plate as a result of the action of the ammunition part or ammunition effect (RSV beam) upon the plate. The said elements can consist of crystals or piezoelectric layers of a type which is known per se.

Figure 3:
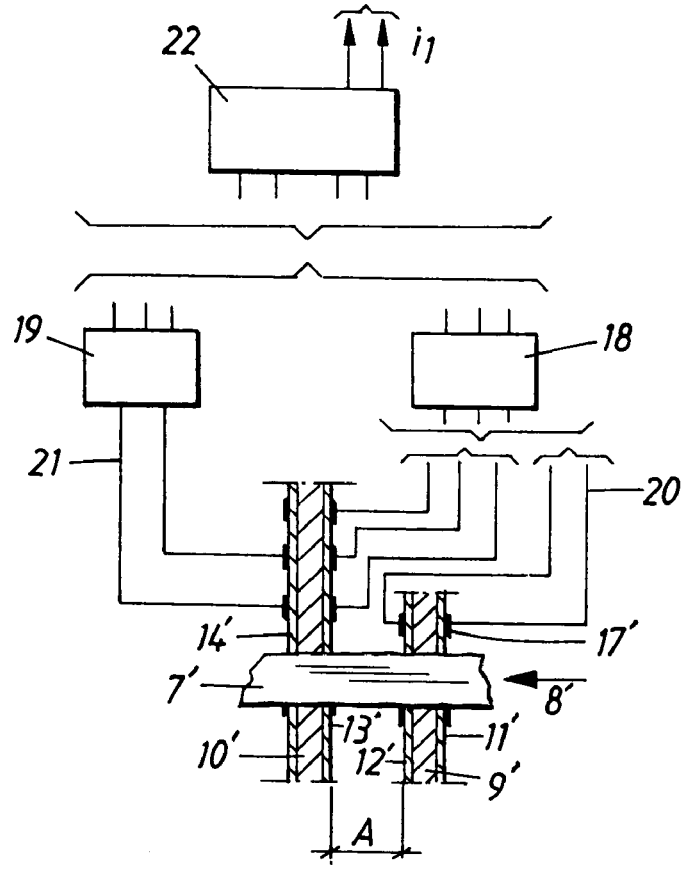
FIG. 3 shows, in circuit diagram form, voltage or current detecting members.

In FIG. 3, for the sake of clarity, only the plastics plates of the IRA modules, with associated foils, are shown. A distance A is indicated between the parallel-arranged plates 9', 10'. The time between the penetration of the ammunition part 7' into the first plate 9' and the second plate 10' in the direction of approach 8' can be measured with electrical detection members 18 and 19, indicated only in basic representation. The detection members are connected to the elements 17' on the sheet-shaped members 11', 12' and 13', 14' of the first and second plates 9' and 10'. The elements are connected to the said detection members 18, 19 by electrical connections, for example electric wires, two of which are denoted by 20 and 21. The ammunition unit 7' first strikes the plate 9' (i.e. the IRA part 3*b* in FIG. 1) and acts upon the voltage-generating elements of this plate, which voltage is registered by the detection members. After this, the ammunition part strikes the second plate 10' (the IRA module 3*a*) and thereby generates voltage in the elements of this plate. The time difference between the penetration of the ammunition unit into the two plates can be measured and thus, for example, the velocity of the penetrating object or the ammunition part 7' can be measured or calculated. This calculation can be performed in a unit 22 which is connected to the units 18 and 19. In dependence on the detection and the calculation, the unit 22 can produce an outgoing aiming or triggering signal i1 to another part of the armour arrangement, for example to the ERA module 4.

Figure 4:
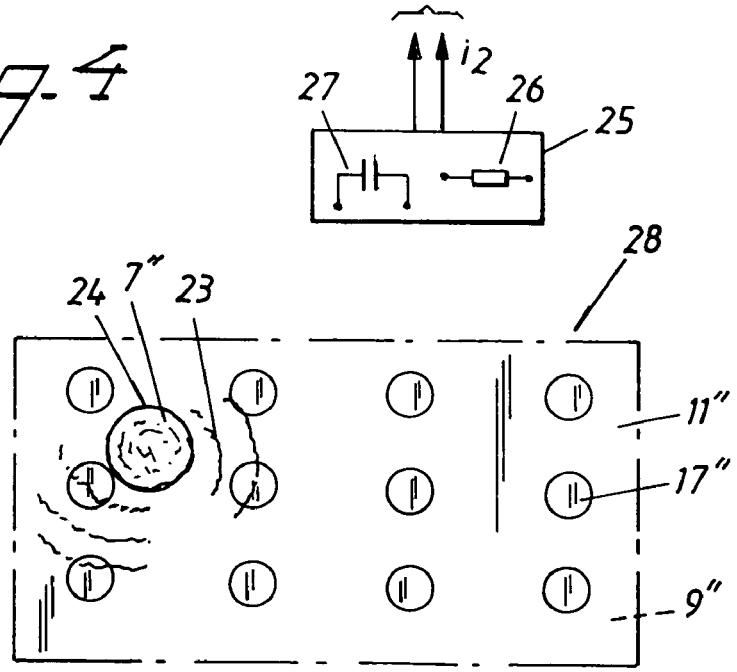
FIG. 4 shows, in circuit diagram form, a current or voltage detecting member in a device which is rotated by 90° in relation to the logic unit according to FIG. 3.

In FIG. 4, the penetrating ammunition part 7' is shown from the rear. The penetration causes shock waves or vibrations 23 to propagate in the material of the plate 9". The shock waves act upon the elements in dependence on how close these are to the point of penetration 24 in question. In the case according to FIG. 4, a unit 25 is used, which detects the effects or the voltage generations from the elements 17". The unit 25 can here have electrical components in the form of a resistor 26, an energy-storing member (capacitor) 27, etc. The unit 25 can in this case store energy which has been generated by the penetration and can produce an outgoing signal i2 for the aiming and triggering of a counteragent (ERA module) in the armour protection. The members which run on voltage, current and/or energy, as well as the signal-processing members, can be constituted by circuits which are known per se and shall not therefore be further described here.

With the aid of the circuits 18, 19, 22 and 25, it is possible to measure the speed difference with which the crystal voltage is generated in the various crystals and in this way to position each exactly on the protection or the total protective surface 28 at which the penetration occurs, i.e. the site 24, so that the possibility is given of choosing a suitable initiation point in the ERA part, which can here be of the type having a plurality of initiation points. As a security condition for the triggering of the ERA part can be used, inter alia, the velocity of the ammunition part 7' or equivalent and, for example, the requirement that this velocity must exceed a certain value. Another condition can be to indicate, for example with the aid of the unit 25, the speed with which the crystal voltage level is built up, and/or the requirement that the built-up crystal voltage must reach a certain level.

The elements 17 can have any chosen shape (round, hexagonal, etc.). The box 6 according to FIG. 1 can include a battery source B and/or an external energy supply Y.

Function Description:

1. A RSV beam (or bolt, splinter) breaks through the armour protection layer.

2. The tip of the RSV beam or equivalent reaches the first IRA module 3*b* and breaks through its first plastics layer. The time calculation thus starts in order to assess whether the ERA module shall be triggered or not. If a velocity of 2 m/s is measured, for example, this can mean that the ammunition unit has collided with a building and has thus deformed the ammunition part, which means that the ERA module shall not be triggered in this case.

3. When the RSV beam reaches the inert material in the first IRA module, shock waves are created in the inert material, which means that the piezoelectric elements deliver voltage due to pressure which is thereby generated. This voltage is used firstly to measure the velocity of whatever impacts or acts upon the protection, and secondly, following storage in a capacitor/capacitors, to initiate the ERA module. The voltage can also be present from the start, for example from a built-in battery or external current source. It is also possible to locate, with the aid of the piezoelectric elements or the crystals, where on the protection the penetration has occurred. The RSV beam or the bolt also gets disturbed during its penetration of the first IRA module according to the above.

4. The process is repeated in the second IRA module 3*a*. With the aid of the two modules 3*a* and 3*b*, the possibility is acquired to determine the velocity of the penetrating object or the effect by virtue of the fact that the time between the impacts upon the two IRA modules can be measured.

The invention is not limited to the embodiment shown by way of example above, but can be subject to modifications within the scope of the following patent claims and the inventive concept.

The invention claimed is:

1. An armor arrangement designed to reduce or eliminate the effect from armor-piercing projectiles, the arrangement comprising:

at least two inertly reactive armor modules comprising crystals or piezoelectric elements arranged on continuous surfaces of inert material of the at least two inertly reactive armor modules and configured to generate electrical voltage when the inertly reactive armor modules are penetrated by a projectile part or projectile effect and in dependence on mechanical vibrations or shock waves;

at least one explosive reactive armor module; and voltage, current and/or energy-detecting member(s) designed, in dependence on the said voltage generation by the elements on the continuous surfaces, to detect a site of a point of penetration on a surface of the arrangement which is exposed to weapon action and, in dependence on the detection, to calculate a velocity of the projectile part or projective effect and if the velocity exceeds a predetermined value, to produce energy or a signal for initiation or triggering function(s) of the at least one explosive reactive armor.

2. The armor arrangement according to claim 1, wherein the at least two inert reactive armor modules arranged spaced apart with respect to a direction of action of the projectiles.

3. The armor arrangement according to claim 1, wherein an additional or alternative triggering condition comprises a rapidity of a voltage build-up in the crystals or the piezoelectric layers and/or a voltage level having a predetermined value or lying within a predetermined value range.

4. The armor arrangement according to claim 1, further comprising:

an energy storage member configured to store energy generated penetration of the inert reactive armor modules by the projectiles.

5. A device for reducing or eliminating effects of armor-piercing projectiles, the device comprising:

at least two inert reactive armor modules arranged spaced apart with respect to a direction of action of the projectiles, each inert reactive armor module comprising subzones arranged spaced apart from each other in a direction of extent of each module, each inert reactive armor module comprising generating elements that, in dependence on mechanical vibrations or shock waves initiate an electrical voltage, at least one explosive reactive armor module;

detection members operatively connected to the generating elements, said detection members being configured to measure a time between penetration of each of the inert reactive armor modules by the projectiles by detecting the electrical voltage generated by the generating elements;

a calculation unit operatively connected to the detection members and configured to calculate a velocity of the projectiles based upon the detected voltage and configured to initiate or provoke initiation of the at least one explosive reactive armor module if the velocity exceeds a predetermined value; and an energy storage member configured to store energy generated penetration of the inert reactive armor modules by the projectiles.

6. The device according to claim 5, wherein the generating elements are disposed on sheet-shaped members and wherein the sheet-shaped members are fixed or baked into the inert material of the respective inert reactive armor module.

7. The device according to claim 5, wherein the generating elements in a first inert reactive armor module can be initiated and thereafter elements on a plate of a second inert reactive armor module can be initiated by projectile part or projectile effect having a direction of penetration wherein the projectile first strikes and punctures the plate of the first inert reactive armor module and subsequently strikes and possibly punctures the plate of the second inert reactive armor module.

8. The device according to claim 5, wherein the detection members comprise part of a detection unit which, in dependence on voltage generation in the generating elements, upon the action of the projectile part or projectile effect, pinpoints a site of a point of penetration in a surface exposable to the projectile action.

* * * * *